US010913637B2

(12) United States Patent
Dellinger et al.

(10) Patent No.: US 10,913,637 B2
(45) Date of Patent: Feb. 9, 2021

(54) METHOD FOR NESTING BULK SEED BOXES

(71) Applicant: MCDOWELL AND DELLINGER, LLC, Vincennes, IN (US)

(72) Inventors: Gregory Dale Dellinger, Vincennes, IN (US); Shawn Brian McDowell, Vincennes, IN (US)

(73) Assignee: MCDOWELL AND DELLINGER LLC, Vincennes, IN (US)

( * ) Notice: Subject to any disclaimer, the term of this patent is extended or adjusted under 35 U.S.C. 154(b) by 0 days.

(21) Appl. No.: 16/853,808

(22) Filed: Apr. 21, 2020

(65) Prior Publication Data

US 2020/0247646 A1 Aug. 6, 2020

Related U.S. Application Data

(62) Division of application No. 15/829,536, filed on Dec. 1, 2017, now Pat. No. 10,625,988.
(Continued)

(51) Int. Cl.
*B66C 1/44* (2006.01)
*B66F 9/19* (2006.01)
*B66F 9/18* (2006.01)

(52) U.S. Cl.
CPC ..... *B66C 1/447* (2013.01); *B66F 9/186* (2013.01); *B66F 9/19* (2013.01)

(58) Field of Classification Search
CPC .. B66F 9/19; B66F 9/186; B66F 9/125; B66F 9/18; A01C 15/006; B65B 25/02;
(Continued)

(56) References Cited

U.S. PATENT DOCUMENTS 2,875,912 A 3/1959 Thresher et al.
2,971,662 A 2/1961 Dunham
(Continued)

FOREIGN PATENT DOCUMENTS

FR 2514738 A1 4/1983

*Primary Examiner* — Glenn F Myers
(74) *Attorney, Agent, or Firm* — Martin IP Law Group; C. Richard Martin

(57) ABSTRACT

The present invention teaches a method for quickly and easily nesting and un-nesting bulk seed boxed. A first lower box is engaged with forks extending from a forklift truck, and the stacked boxes are elevated to a target height. Next, the forklift truck is advanced forward until the stacked boxes are in position in a box inverter apparatus, wherein the stacked boxes are positioned between opposing box engaging surfaces of rotary clamp pads. The rotary clamp pads engage the stacked boxes at a clamping location below the center of mass of the second, upper box unit. The forks of the fork truck carrying the first, lower box unit are then lowered until the first lower box unit is separated from the second, upper box unit, thereby affecting rotation of the second, upper box unit and rotary clamp pads until the second, upper box unit rotates a full 180 degrees to an inverted position. The forks carrying the lower box unit are raised upwardly such that the lower box unit nests inside the now inverted upper box unit. The rotary clamp pads are released from engagement with the outer surfaces of the upper box unit. Lastly, the nested first and second box units are removed from the box inverter apparatus.

7 Claims, 8 Drawing Sheets

Related U.S. Application Data

(60) Provisional application No. 62/429,108, filed on Dec. 2, 2016.

(58) Field of Classification Search
CPC ..... B65B 25/046; B66C 1/0262; B66C 1/447; B66C 1/663; B66C 1/66
See application file for complete search history.

(56) References Cited

U.S. PATENT DOCUMENTS

| | | | | |
|---|---|---|---|---|
| 3,971,485 | A | 7/1976 | Hoppey | |
| 4,238,169 | A | 12/1980 | Depriester et al. | |
| 4,272,217 | A | 6/1981 | Sefcik | |
| 4,524,683 | A | 6/1985 | Parker et al. | |
| 4,838,752 | A | 6/1989 | Bryant | |
| 5,009,565 | A | 4/1991 | Esau | |
| 6,722,841 | B2 | 4/2004 | Haas | |
| 8,545,161 | B2 | 10/2013 | Wanek-Pusset et al. | |
| 8,632,296 | B1 | 1/2014 | Binford et al. | |
| 8,796,981 | B2 | 8/2014 | Zindel | |
| 8,926,260 | B2 | 1/2015 | Parslow, II et al. | |
| 2003/0091419 | A1* | 5/2003 | Haas | B66F 9/19 414/607 |
| 2005/0060932 | A1* | 3/2005 | Ramp | B66C 1/66 47/67 |
| 2005/0074316 | A1 | 4/2005 | Hedley | |
| 2010/0166531 | A1 | 7/2010 | Bauer | |

* cited by examiner

METHOD FOR NESTING BULK SEED BOXES

BACKGROUND OF THE INVENTION

Field of the Invention

The present invention relates generally to the handling and manipulation of large containers. More specifically, the present invention relates to a device and method for handling, manipulating and positioning a first seed box in a first nested position on a second smaller seed box for storage.

Description of the Related Art

Bulk handling of seed in the agricultural seed industry is becoming more commonplace. To this end, large boxes made of high strength plastic are used for receiving and storing the seed prior to planting. In one approach, the boxes are of two different sizes to allow a first box open at the top and bottom to be positioned on a smaller second box in a stacked array to receive a large quantity of seed, or to be positioned over the second box in a nested configuration when inverted for compact storage of the boxes when not in use. The boxes themselves are typically quite heavy, requiring at least two workers to position the boxes in either the stacked configuration for receiving seed or in the nested configuration for storage. Manual handling of these large, heavy seed boxes makes their transport difficult, labor intensive and expensive.

Some automated approaches have been proposed. For example, U.S. Pat. No. 6,722,841 issued to Haas teaches an apparatus adapted for attachment to a conventional lift device such as a forklift or an end loader, or the like, that includes a pair of movable side arms each attached to a respective end of a cross member. Each side arm has attached thereto a respective engaging member for engaging lateral ribs of a first seed box for lifting the seed box. The apparatus further includes a pivoting connection for rotating the first seed box to an inverted orientation for positioning on a second seed box in a nested configuration for storage. Similarly, U.S. Pat. No. 8,926,260 issued to Parslow, II et al. teaches an automated, high volume container manipulator and process useful with an agricultural seed box where the manipulator removes an upper ring of a seed box, rotates the ring 180 degrees and places the ring over the lower seed box base in a nested condition.

SUMMARY OF THE INVENTION

It is therefore an object of the present invention to provide a method and apparatus for inverting a first seed box for nesting in a second seed box for storage that uses gravity to invert the box for nesting.

It is also an object of the invention to provide a method and apparatus for inverting a first seed box for nesting in a second seed box for storage that can be used with a common fork truck that is commonly used to move such seed boxes.

According to one aspect of the present invention, a box inverter apparatus for use in connection with a forklift truck to nest a pair of bulk seed boxes is provided. The apparatus includes first and second rotary clamp pads, each clamp pad having a box engaging surface and an opposing rear surface. The first and second rotary clamp pads are positioned such that the box engaging surfaces thereof face one another in a spaced apart relationship. First and second spindle and bearing assemblies are associated with and extend radially outwardly from the opposing rear surfaces of the first and second rotary clamp pads, respectively. Each of the spindle and bearing assemblies has a first end attached to the rear surface of the rotary clamp pad and a second end attached to a frame such that each spindle and bearing assembly permits rotation of the rotary clamp pad relative to the frame. Means for adjusting the distance between the spaced apart facing box engaging surfaces of the first and second rotary clamp pad assemblies are provided. Further, positioning means for determining and selecting an optimal positioning of the pair of bulk seed boxes in between the opposing box engaging surfaces of the first and second rotary clamp pads are provided. Lastly, according to this aspect, the box inverter apparatus includes means for actuating the adjusting means to affect engagement of the box engaging surfaces with opposing sides of one of the pair of bulk seed boxes.

The box inverter apparatus may further include a viscous rotary speed governing device affixed to one of the spindle and bearing assemblies to control the rotation of one of the pair of bulk seed boxes.

The distance adjusting means referenced above may include first and second pneumatic cylinders. Each pneumatic cylinder may include a first end connected to the frame and a second end connected to a corresponding one of the first and second rotary clamp pads. The frame may include a base frame assembly and a pair of substantially vertical clamp arm assemblies. Each clamp arm assembly is pivotally connected to the frame at a first end thereof and connected to the spindle and bearing assembly proximal to a second end thereof. The second end of each pneumatic cylinder is attached to a corresponding one of the clamp arm assemblies.

The actuating means referenced above may include a pneumatic valve in fluid communication with the first and second pneumatic cylinders.

The positioning means referenced above may include a device for engaging a portion of the forklift truck as the pair of bulk seed boxes reach the optimal depth relative to the apparatus. The engaging device may include a pair of wheel chocks for engaging a pair of front wheels of the forklift truck. The wheel chocks are connected to the frame by one or more pivot links which permit the wheel chocks to be moved between an operating position and a stored position. Alternatively, the positioning means may include a target height indicator. The target height indicator may be a flexible pointer aligned with the middle of a beveled corner of a base of one of the pair of boxes. According to another embodiment, the positioning means further comprises visible crossing vertical and horizontal laser cross lines.

A further aspect of the present invention is a method for nesting a first box unit and a second box unit that are in a stacked arrangement. A lower surface of the first lower box unit is engaged with forks extending from a forklift truck. The stacked first and second box units are then elevated to a target height. The forklift truck is advanced forward until the stacked first and second box units are in a predetermined horizontal position in a box inverter apparatus. In this state, the stacked first and second box units are positioned between opposing box engaging surfaces of first and second rotary clamp pads associated with the box inverter apparatus. Next, the rotary clamp pads are moved toward the stacked first and second box units until the opposing box engaging surfaces engage opposing outer surfaces of the second, upper box unit at a clamping location below the center of mass of the second, upper box unit. The forks of the fork truck carrying the first, lower box unit are lowered until the first lower box unit is separated from the second, upper box unit, thereby affecting rotation of the first, upper box unit and rotary clamp pads about first and second spindle and bearing assemblies associated with and extending radially outwardly from opposing rear surfaces of the first and second rotary clamp pads until the second, upper box unit rotates a full 180 degrees to an inverted position. The forks carrying the lower box unit are raised upwardly such that the lower box unit nests inside the now inverted upper box unit. The rotary clamp pads are released from engagement with the outer surfaces of the upper box unit. Finally, the nested first and second box units are removed from the box inverter apparatus.

The rotary clamp pads may engage and release the upper box unit by way of pneumatic cylinders actuated by a pneumatic valve. The rotation of the upper box and rotary clamp pads is controlled by a viscous rotary speed governing device attached to one of the first and second spindles.

The predetermined horizontal position is reached by way of one or more wheel chocks which are located in front of a frame of the box inverter apparatus and engage one or more front wheels of the forklift truck when the forklift truck reaches the predetermined horizontal position. The target height is identified by visual indication of a flexible pointer aligned with a midpoint of a beveled corner of a base of one of the first or second box units. Alternatively, the target height is determined by a horizontal segment of visible laser cross lines, and the predetermined horizontal position is determined by a vertical segment of the laser cross lines.

These and other objects, features and advantages of the present invention will become apparent from a review of the following drawings and detailed description of the preferred embodiments of the invention.

BRIEF DESCRIPTION OF THE DRAWINGS

The present invention can best be understood in connection with the accompanying drawings. It is noted that the invention is not limited to the precise embodiments shown in the drawings, in which.

DETAILED DESCRIPTION OF THE INVENTION

Figure 1B:
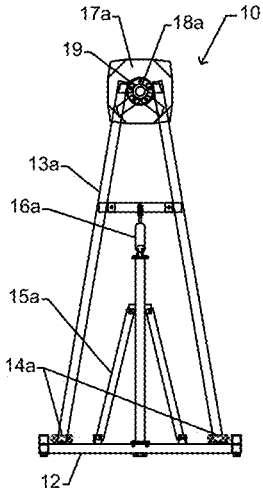
FIG. 1B is a side view in elevation of the pneumatic clamp box inverter shown in FIG. 1A.

For purposes of promoting and understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

Figure 1A:
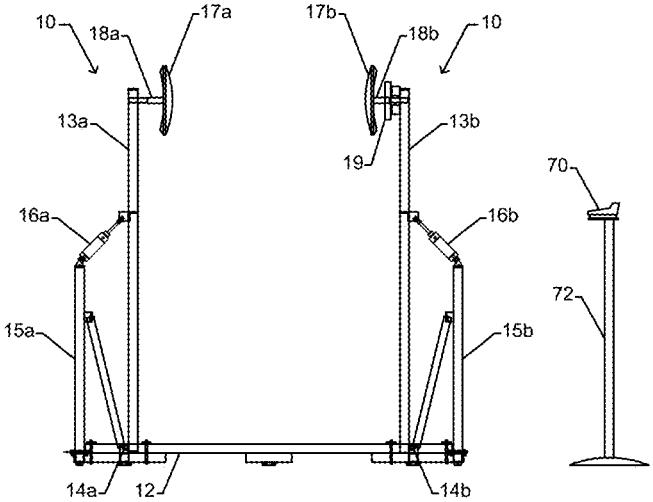
FIG. 1A is a front view in elevation of a pneumatic clamp box inverter shown in a clamped position according to one presently preferred embodiment of the invention.

As best shown in FIG. 1A and FIG. 1B, a pneumatic clamp box inverter 10 according to one presently preferred embodiment of the invention is provided having a base frame assembly 12, which is preferably a substantially rectangular frame as shown in FIG. 1A and FIG. 1B. First and second clamp arm assemblies 13*a*, 13*b* extend upwardly from the base frame 12 and are pivotally affixed to the base frame 12 by pivot fittings 14*a*, 14*b*. As best shown in FIG. 1B, each clamp arm assemblies 13*a*, 13*b* has a substantially A-shaped cross section to provide stability for the device. Outboard vertical support members 15*a*, 15*b* are further provided for supporting corresponding pneumatic cylinders 16*a*, 16*b* which, upon actuation, rotate the respective clamp arm assemblies about pivot fittings 14*a*, 14*b* to engage or disengage a pair or rotary clamp pad assemblies 17*a*, 17*b* with the outer surface of an upper seed box 30*a* to be inverted. The rotary clamp pad assemblies 17*a*, 17*b* extend inwardly from points near the upper ends of the clamp arm assemblies 13*a*, 13*b* and are connected to the clamp arm assemblies 13*a*, 13*b* via spindle and bearing assemblies 18*a*, 18*b* which allow rotation of the clamp pad assemblies 17*a*, 17*b*. The clamp pads 17*a*, 17*b* consist of rubber tread like surface capable of gripping the plastic structural ribs of the upper box unit. A viscous rotary speed governing device 19 is provided to control the rotation and contact with the lower box unit 30*b* as it pulls away.

Figure 2A:
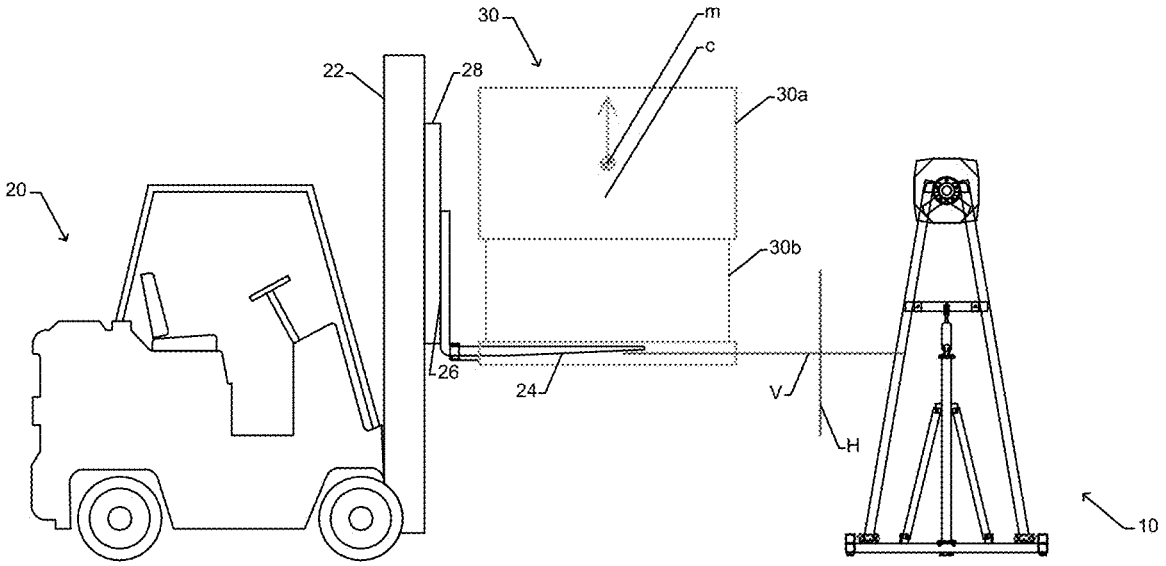
FIG. 2A is a side view in elevation of a forklift carrying a pair of un-nested seed boxes approaching the pneumatic clamp box inverter shown in FIG. 1B.
Figure 2B:
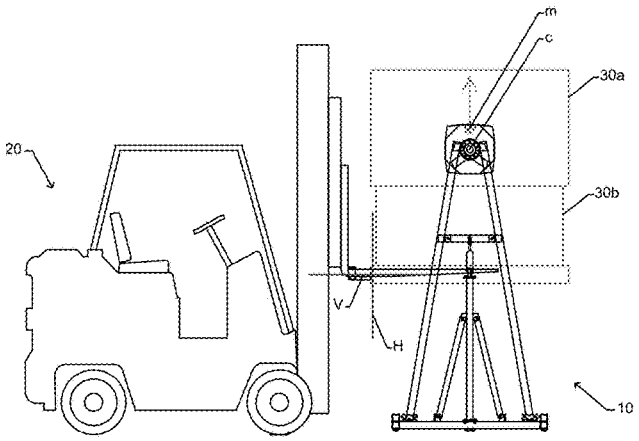
FIG. 2B is a side view in elevation of a forklift carrying a pair of un-nested seed boxes in position at the pneumatic clamp box inverter shown in FIG. 1B for rotation of the upper box.
Figure 9A:
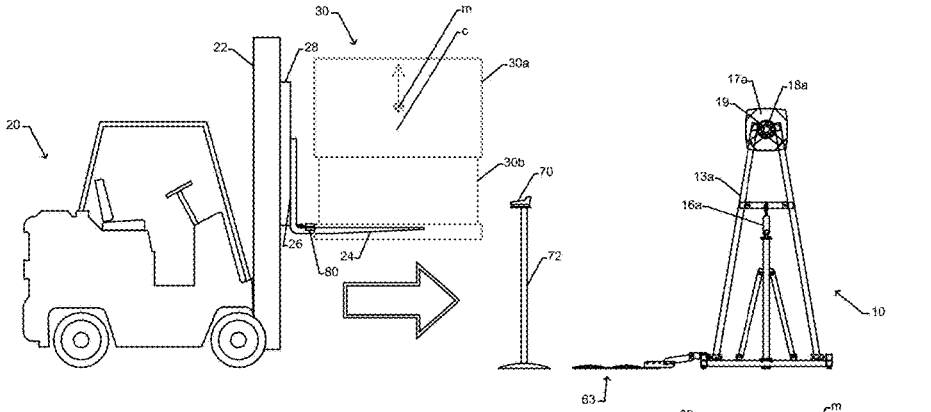
FIG. 9A is a side view in elevation of a forklift carrying a pair of un-nested seed boxes approaching the pneumatic clamp box inverter shown in FIG. 8B.
Figure 9B:
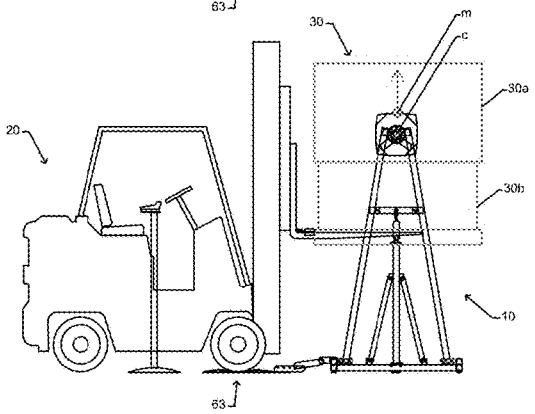
FIG. 9B is a side view in elevation of a forklift carrying a pair of un-nested seed boxes in position at the pneumatic clamp box inverter shown in FIG. 8B for rotation of the upper box.

The operation of the basic system according to one preferred embodiment of the invention is shown in FIG. 2A and FIG. 2B. A standard fork truck 20 as is known in the art is used to transport an empty two-piece nesting bulk seed box assembly 30*a*, 30*b* in the storage configuration with the lid removed to and from the pneumatic clamp box inverter 10. The fork truck includes a mast 22, forks 24, carriage 26 and load backrest 28. A standoff or spacer block 80 (FIG. 9A) may be attached to the forks 24 of the fork truck 20 to allow placement of the stacked or nested boxes 30*a*, 30*b* on the forks 24 with a consistent gap from the forklift mast 22. This uniform gap allows clearance for rotation of the upper box unit 30*a* and adjustment if necessary as the lower box unit 30*b* is nested into the upper box unit 30*a* after inversion.

To initiate the process of nesting the upper box unit 30*a* and lower box unit 30*b*, the fork lift 20 elevates the boxes 30*a*, 30*b* to the target height as shown in FIG. 2A. According to a preferred embodiment of the invention, the operator positions the upper box unit 30*a* so that the lowest portion of the clamp pads 17*a*, 17*b* are aligned with the lowest edge of the upper box unit 30*a*. This method works for both modes of operation: nested to un-nested, and un-nested to nested. Alternatively, the target height can be identified by visual indication of a flexible pointer (not shown) aligned with the middle of the beveled corner of the box base, or by the horizontal segment H of visible laser cross lines. Additional reference for elevation and mast angle may be accomplished by magnetic indicators attached to the forklift mast.

Once the upper box unit 30*a* is at the target height, the fork lift 20 advances forward to position the boxes 30*a*, 30*b* in the correct horizontal position as shown in FIG. 2B. Accordingly to this embodiment, this location is indicated by the vertical segment V of the laser cross lines or the flexible pointer (not shown). The steps of elevating the boxes 30*a*, 30*b* to the target height and positioning the boxes 30*a*, 30*b* in the correct horizontal position can be done simultaneously or sequentially with either step being done first until the box units 30*a*, 30*b* are in the correct horizontal and vertical position shown in FIG. 2B.

Once the boxes 30*a*, 30*b* are is in position as shown in FIG. 2B, the fork truck operator actuates a pneumatic valve 70 (FIG. 8A) on a movable post 72 stationed next to the fork lift. The pneumatic valve 70 actuates pneumatic cylinders 16*a*, 16*b* which extend and the clamp arms 13*a*, 13*b* pivot inward toward the upper box unit 30*a*, so that the rotary clamp pad assemblies 17*a*, 17*b* engage and grip the plastic structural ribs of the upper box unit 30*a*. The clamping location C is below the center of mass M of the upper box unit 30*a*.

Figures 3A, 3B, 3C, 3D, 3E, 3F:
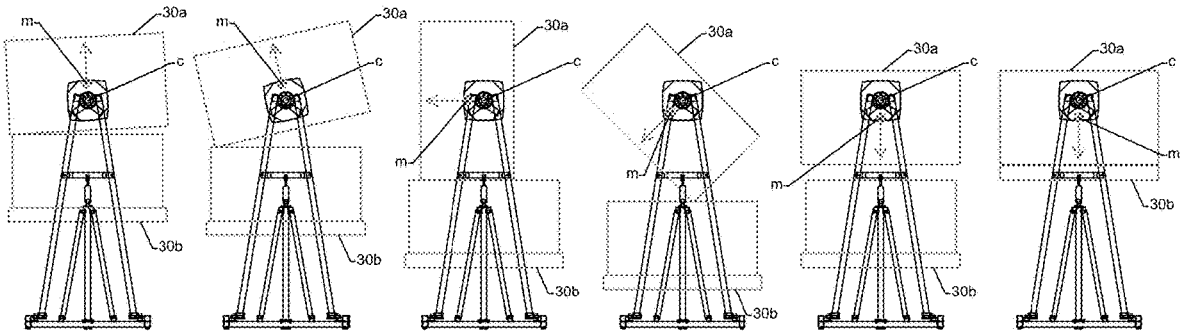
FIGS. 3A-3F show the sequence in which the pneumatic clamp box inverter inverts the upper box and nests it on the lower box according to a preferred embodiment of the invention shown in FIG. 2A and FIG. 2B.

Once the upper box unit 30*a* is clamped, the operator lowers the forks 24 carrying the lower box unit 30*b* which begins to pull away from the upper box unit 30*a* as best shown in FIG. 3. Once free from the lower box unit 30*b* (FIG. 3A), the upper box unit 30*a* begins to rotate about the clamp spindles 18*a*, 18*b* due to the force of gravity. The rotation is controlled by the viscous rotary speed governing device 19 and contact with the lower box unit 30*b* as it pulls away from the upper box unit 30*a* (FIG. 3B, FIG. 3C & FIG. 3D). The upper box unit 30*a* rotates a full 180 degrees to the inverted position (FIG. 3E).

The fork lift operator then raises the lower box unit 30*a* back up into the inverted upper box unit 30*b* until near the fully nested position (FIG. 3F). The operator then presses the hand activated valve 70 and the pneumatic cylinders 16*a*, 16*b* retract causing the clamp pads 17*a*, 17*b* to release the upper box unit 30*a*. The upper box unit 30*a* then settles into the fully nested position and the operator backs the forklift 20 away from the clamp device 10 with the bulk seed boxes 30*a*, 30*b* in the nested configuration.

The process may be reversed—modifying the bulk seed box units 30*a*, 30*b* from a nested configuration to a non-nested storage configuration—by essentially following the same steps as outlined above. However, to accomplish this task, the position of the laser or flexible pointer must be raised so that when aligned, the upper box unit 30*a* is gripped at an alternate clamping point C' which is located a predetermined distance below the center of mass M of the upper box unit 30*a*.

Figure 4A:
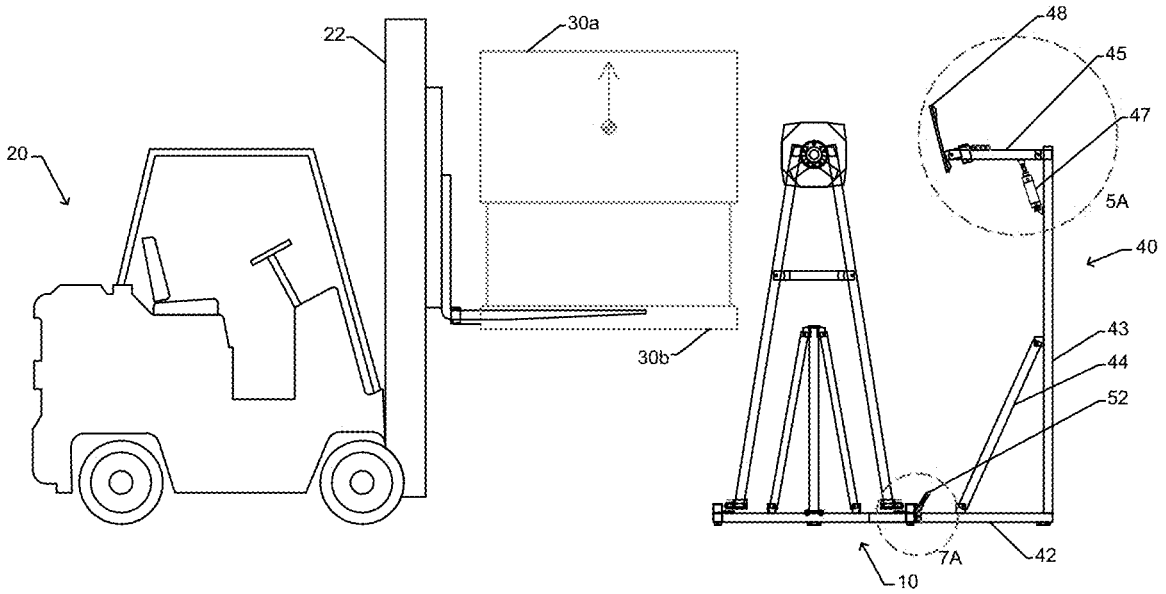
FIG. 4A is a side view in elevation of a forklift carrying a pair of un-nested seed boxes approaching a pneumatic clamp box inverter having an optional automatic assembly according to an alternative embodiment of the invention.

According to an alternative embodiment of the invention, means for positioning the upper box unit 30*a* and lower box unit 30*b* for processing as shown in FIG. 4A may be provided. According to this embodiment, the process can be automated so that the fork truck operator does not have to manually activate a switch to activate the pneumatic cylinders 16*a*, 16*b* to engage and disengage the rotary clamp pad assemblies 17*a*, 17*b* from the upper box unit 30*a*. With this additional hardware the forklift operator brings the boxes 30*a*, 30*b* into the correct position and completes the entire process by the raising and lowering of the forks 24 with final release of the box triggered by the hand activated valve 70 on post 72. This functionality is powered with only compressed air utilizing pneumatic limit switches and valves.

Figure 4B:
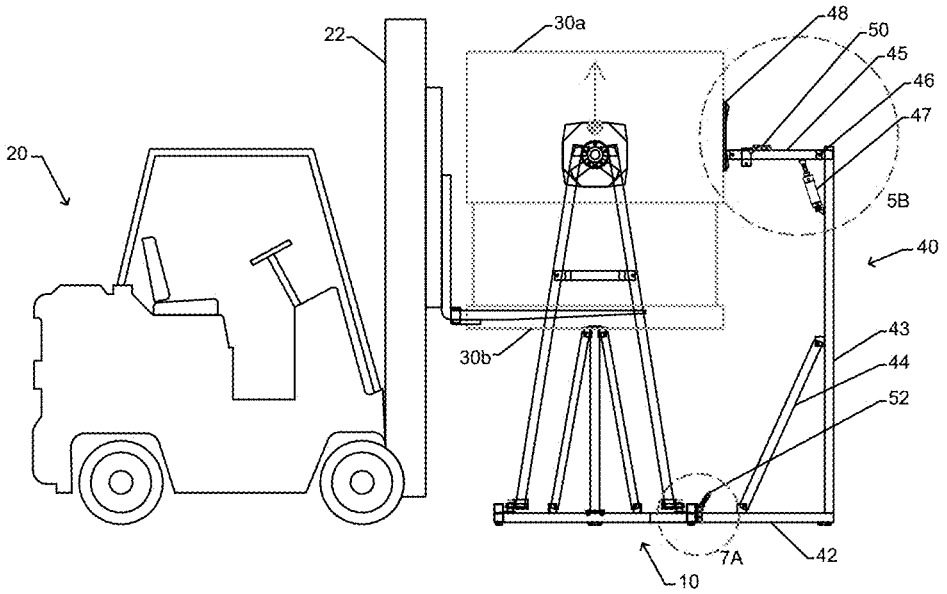
FIG. 4B is a side view in elevation of a forklift carrying a pair of un-nested seed boxes in position at the pneumatic clamp box inverter shown in FIG. 4A for rotation of the upper box.

As best shown in FIG. 4A and FIG. 4B, the means for positioning may include an automatic actuating unit 40 is attached to the rear of the pneumatic clamp box inverter 10. The automatic actuating unit 40 includes a base frame member 42 which attaches to the base frame member 12 of the pneumatic clamp box inverter 10 and extends outwardly from the rear thereof. A vertical post 43 extends upwardly from the rear end of the base frame member and is braced by cross brace 44. A cross member 45 is attached to the upper end of the vertical post 43 via a pivotal fitting 46. A pneumatic cylinder 47 having a first end connected to the vertical post 43 and a second end connected to the cross member 45 is provided to cause the cross member 45 to pivot relative to the vertical post 43 upon actuation. a pad assembly 48 is pivotally attached to the other end of the cross member 45 by a pivot fitting 49. A first limit switch 50 is provided to detect whether the pad assembly 48 is sensing that a box 30 is in the loaded position (FIG. 4B and FIG. 5B). A second limit switch 52 is positioned on the base frame member 42 to detect when lower box assembly 30*b* has been lowered into the fully downward position.

As shown in FIG. 4A, the operator retrieves the boxes 30*a*, 30*b* as with the previously described embodiment. As the boxes 30*a*, 30*b* enter the pneumatic clamp box inverter 10, the upper box 30*a* contacts the pad assembly 48. The referencing spacer blocks attached to the bottom of the forks no longer contact the bottom edge of the boxes 30*a*, 30*b* and allow the boxes 30*a*, 30*b* to move towards the mast 22 indicating to the operator that contact has been made and the boxes 30*a*, 30*b* is positioned to the correct depth in the pneumatic clamp box inverter 10. As shown in FIG. 4B and FIG. 5B, when the boxes 30*a*, 30*b* contacts the rear pad 48, the pad is pivoted around pivot point 49 until the pneumatic limit switch 50 is activated, latching a pneumatic valve which triggers the clamping action of the side cylinders 16*a*, 16*b*.

Figure 6A:
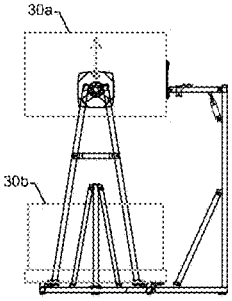
FIGS. 6A-6E shows the sequence in which the pneumatic clamp box inverter inverts the upper box and nests it on the lower box according to the alternative embodiment of the invention shown in FIG. 4A and FIG. 4B.
Figure 6B:
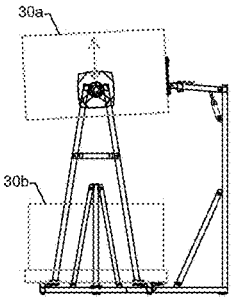
Figure 6C:
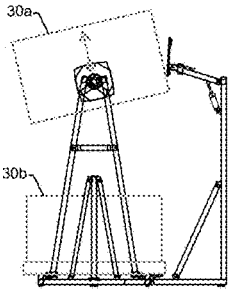
Figure 6D:
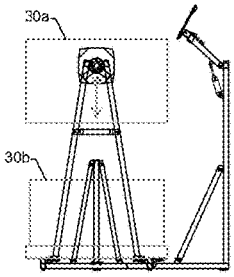
Figure 6E:
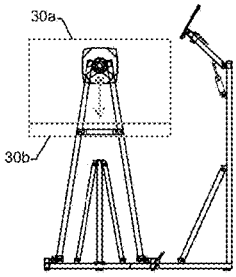
Figure 7A:
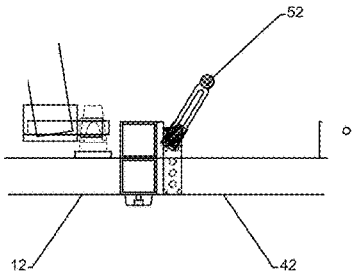
FIG. 7A is a detailed view of the area within the area 7A of FIG. 4A depicting a lower limit switch.
Figure 7B:
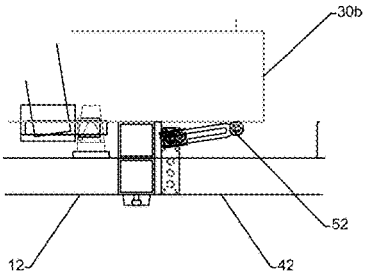
FIG. 7B shows the area and lower limit switch depicted in FIG. 7A with the forklift and boxes shown in a lowered position.

Once clamped, the operator lowers the lower box unit 30*b*, as best shown in FIG. 6A. Instead of rotation occurring as in the manual configuration, the upper box 30*a* is held in place by the rear pad 48. As shown in FIG. 6B, when the lower box unit 30*b* is lowered onto the machine base 42, the second pneumatic limit switch 52 is activated as shown in FIG. 7B latching a pneumatic valve which extends the pneumatic cylinder 47 of the automatic actuating unit 40. As the cylinder 47 extends, it initiates the rotation of the upper box unit 30*a*, as best shown in FIG. 6C and FIG. 6D. The upper box unit 30*a* completes a full 180 degree inversion controlled by the viscous speed governor 19. Finally, as shown in FIG. 6E, when the inversion is complete the operator raises the lower box unit 30*b* into the upper box unit 30*a*.

Figure 5A:
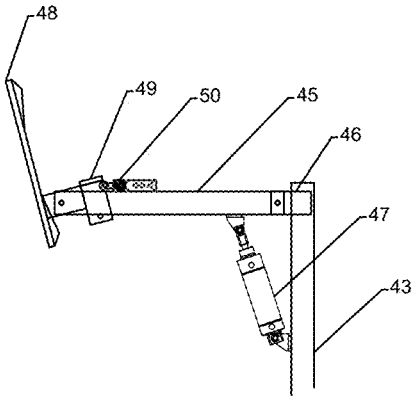
FIG. 5A is a detailed view of the area within the area 5A of FIG. 4A.
Figure 5B:
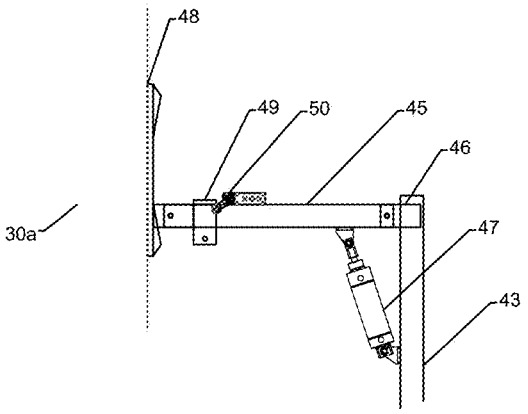
FIG. 5B is a detailed view of the area within the area 5B of FIG. 4B.

The operator then presses the hand activated valve 70 on the post 72 (FIG. 8A) to unlatch the pneumatic valves and release the clamping cylinders 16*a*, 16*b* and bring the rear pad 48 back into position (FIG. 5A). As with the first embodiment, this process can be utilized for changing the nesting box between both configuration states.

An alternative means for positioning the upper box unit 30*a* and lower box unit 30*b* for processing is shown in FIGS. 8A-8D. The positioning means according to this embodiment includes first and second stops 60*a*, 60*b* configured to engage the front wheels 21*a*, 21*b* of the fork truck 20 when it reaches the correct depth for engagement. Each of the first and second stops 60*a*, 60*b* includes a mounting bracket 61 which is affixed to the base frame 12 of the box inverter 10. A pivot arm 62 has a first end pivotally engaging a free end of the mounting bracket 61 and a second end which pivotally engages a wheel chock 63 at an adjustable bracket 64. The wheel chock 63 according to a preferred embodiment includes two raised areas 65, 66 on the ends with a recessed area 67 located in between. The recessed area 67 may preferably be sized such that it corresponds roughly to the diameter of front wheel 21*a*, 21*b* of the fork truck 20 so that when the front wheels 21*a*, 21*b* come to rest in the the corresponding recessed areas 67*a*, 67*b* of the corresponding chocks 63*a*, 63*b*, the fork truck 20 is secured in place against forward or backward movement with the fork and nested upper and lower boxes 30*a*, 30*b* at the correct depth relative to the box inverter 10.

Figure 8B:
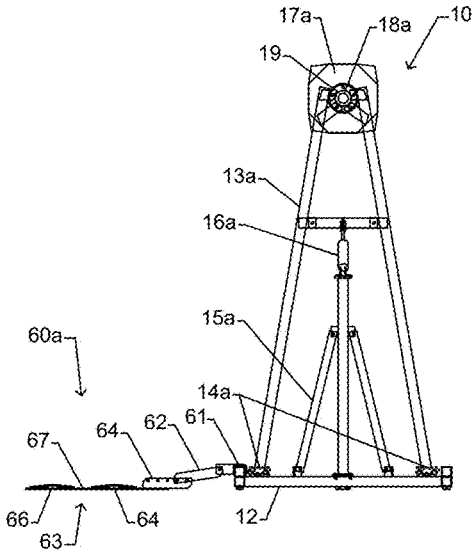
FIG. 8B is a side view in elevation of the pneumatic clamp box inverter shown in FIG. 8A.
Figure 8A:
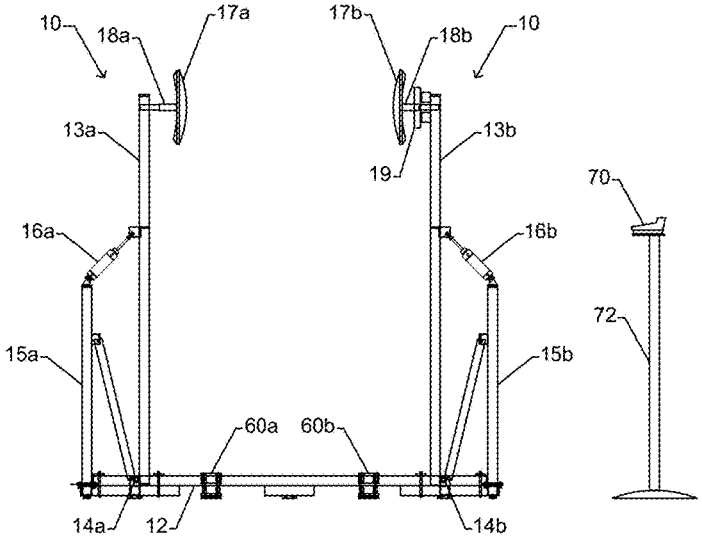
FIG. 8A is a front view in elevation of a pneumatic clamp box inverter shown in a clamped position according to an alternative preferred embodiment of the invention.
Figure 8D:
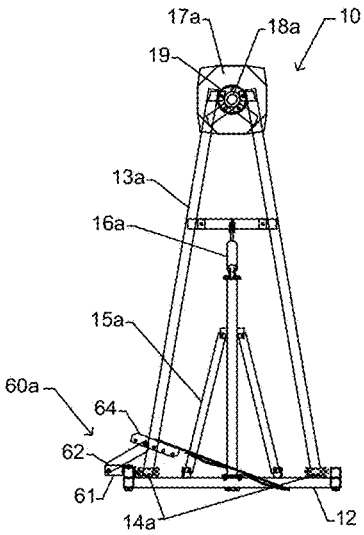
FIG. 8D is a side view in elevation of the pneumatic clamp box inverter shown in FIG. 8A, with the wheel stop shown in the folded, storage position.
Figure 8C:
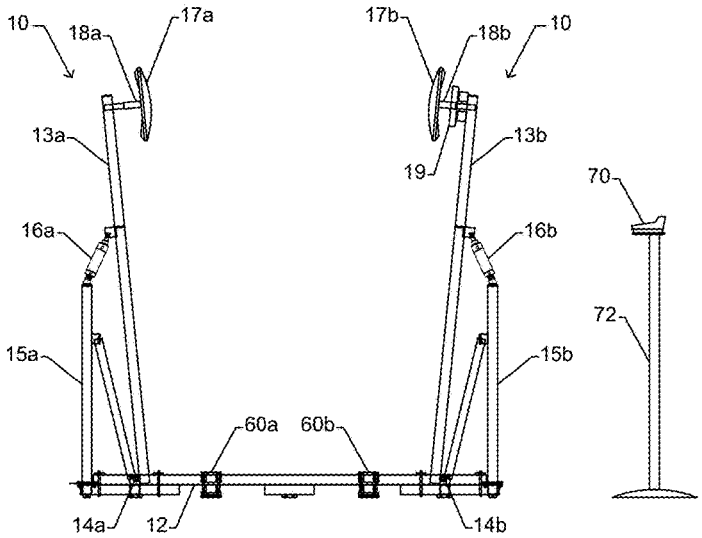
FIG. 8C is a front view in elevation of the pneumatic clamp box inverter of FIG. 8A shown in an open, unclamped position.

Once the front wheels 21*a*, 21*b* of the fork truck 20 are properly located in the recessed areas 67*a*, 67*b* of the chocks 63*a*, 63*b*, the fork truck operator can adjust the side-to-side position of the forks 24 carrying the nested boxes 30*a*, 30*b* to ensure that the boxes are properly centered in the machine 10 and also raise or lower the forks 24 and boxes 30*a*, 30*b* to the correct height. If the wheels 21*a*, 21*b* are properly positioned in the recessed areas 67*a*, 67*b*, it will only be necessary to move the forks 2-3 inches to the left or right to properly center the boxes 30*a*, 30*b* in the machine 10. Once the boxes 30*a*, 30*b* are in the proper position, the fork truck operator presses the hand activated valve 70 on the post 72 to unlatch the pneumatic valves and release the clamping cylinders 16*a*, 16*b* moving the first and second clamp arm assemblies 13*a*, 13*b* and the rotary clamp pad assemblies 17*a*, 17*b* from the disengaged position (FIG. 8C) to the engaged position (FIG. 8A).

Figure 10A:
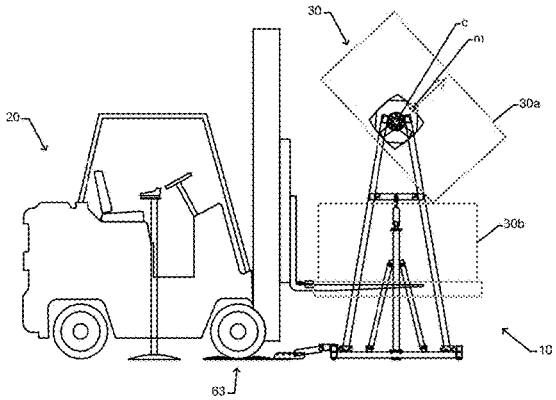
FIGS. 10A-10E show the sequence in which the pneumatic clamp box inverter inverts the upper box and nests it on the lower box according to the alternative embodiment of the invention shown in FIG. 9A and FIG. 9B.
Figure 10B:
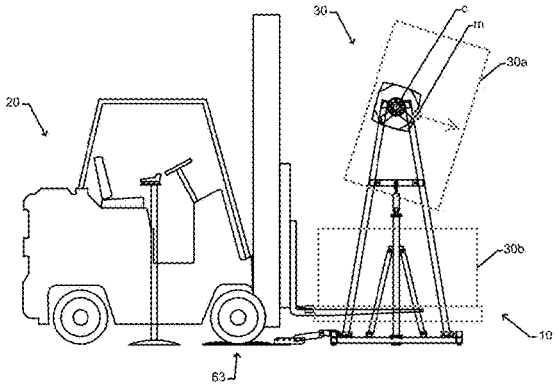
Figure 10C:
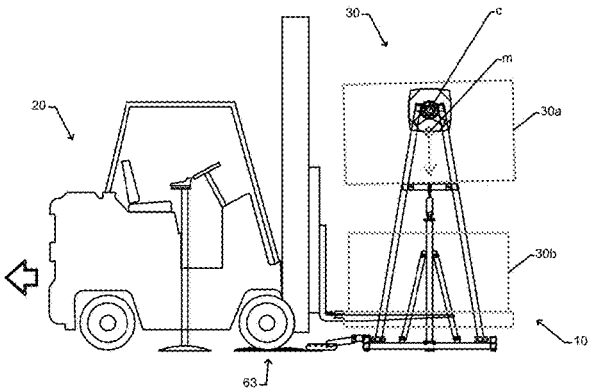

Once the upper box unit 30*a* is clamped, the operator lowers the forks 24 carrying the lower box unit 30*b* which begins to pull away from the upper box unit 30*a*. Once free from the lower box unit 30*b* (FIG. 10A), the upper box unit 30*a* begins to rotate about the clamp spindles 18*a*, 18*b* due to the force of gravity. The rotation is controlled by the viscous rotary speed governing device 19 and contact with the lower box unit 30*b* as it pulls away from the upper box unit 30*a* (FIG. 10A, FIG. 10B). The upper box unit 30*a* rotates a full 180 degrees to the inverted position (FIG. 10C).

Figure 10D:
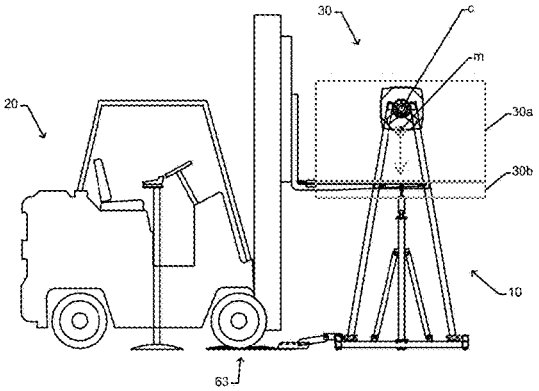
Figure 10E:
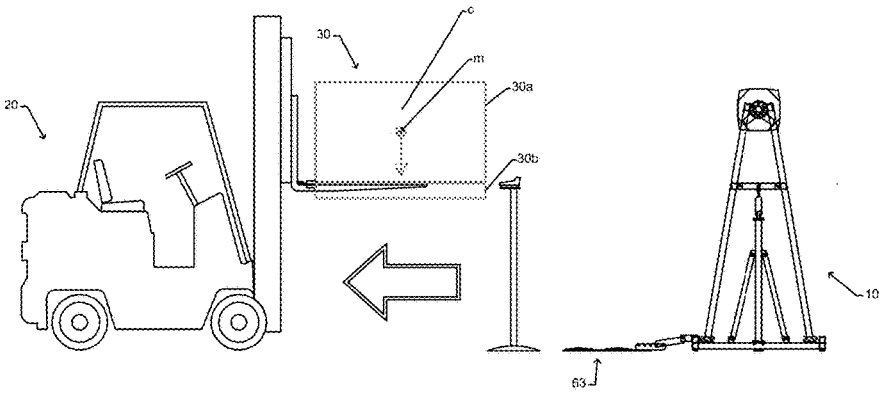

The fork lift operator then raises the lower box unit 30*a* back up into the inverted upper box unit 30*b* until near the fully nested position (FIG. 10D). The operator then presses the hand activated valve 70 and the pneumatic cylinders 16*a*, 16*b* retract causing the clamp pads 17*a*, 17*b* to release the upper box unit 30*a*. The upper box unit 30*a* then settles into the fully nested position and the operator backs the forklift 20 away from the clamp device 10 with the bulk seed box 30 in the nested configuration (FIG. 10E). As with the first embodiment, this process can be utilized for changing the nesting box between both configuration states.

It is critical to the operation of the clamp device 10 that the boxes 30*a*, 30*b* be positioned at the proper depth relative to the machine 10. If the boxes 30*a*, 30*b* are loaded too deep into the machine 10, the boxes 30*a*, 30*b* will not rotate completely and thus will not easily re-stack by merely raising the forks 24 after rotation. Similarly, if the boxes 30*a*, 30*b* are loaded too shallow into the machine 10, the boxes 30*a*, 30*b* will over-rotate causing the same problem. The positioning means described above with regard to the various embodiments of the invention are utilized to ensure proper depth before the clamp arm assemblies 17*a*, 17*b* engage the upper box unit 30*a*.

This detailed description, and particularly the specific details of the exemplary embodiment disclosed, is given primarily for clearness of understanding and no unnecessary limitations are to be understood therefrom, for modifications will become evident to those skilled in the art upon reading this disclosure and may be made without departing from the spirit or scope of the claimed invention.

We claim:

1. A method for nesting a first box unit and a second box unit that are in a stacked arrangement comprising the steps of:

engaging a lower surface of said first lower box unit with forks extending from a forklift truck;

elevating the stacked first and second box units to a target height;

advancing the forklift truck forward until the stacked first and second box units are in a predetermined horizontal position in a box inverter apparatus, wherein the stacked first and second box units are positioned between opposing box engaging surfaces of first and second rotary clamp pads associated with the box inverter apparatus;

moving the rotary clamp pads toward the stacked first and second box units until said opposing box engaging surfaces engage opposing outer surfaces of said second, upper box unit at a clamping location below the center of mass of the second, upper box unit;

lowering the forks of the fork truck carrying the first, lower box unit until said first lower box unit is separated from said second, upper box unit, thereby affecting rotation of the second, upper box unit and rotary clamp pads about first and second spindle and bearing assemblies associated with and extending radially outwardly from opposing rear surfaces of said first and second rotary clamp pads until the second, upper box unit rotates a full 180 degrees to an inverted position;

raising the forks carrying the lower box unit upwardly such that the lower box unit nests inside the now inverted upper box unit;

releasing the rotary clamp pads from engagement with the outer surfaces of the upper box unit;

removing the nested first and second box units from the box inverter apparatus.

2. The method of claim 1 wherein the rotary clamp pads engage and release the upper box unit by way of pneumatic cylinders actuated by a pneumatic valve.

3. The method of claim 1 wherein the rotation of the upper box and rotary clamp pads is controlled by a viscous rotary speed governing device attached to one of the first and second spindles.

4. The method of claim 1 wherein the predetermined horizontal position is reached by way of one or more wheel chocks which are located in front of a frame of the box inverter apparatus and engage one or more front wheels of the forklift truck when the forklift truck reaches the predetermined horizontal position.

5. The method of claim 1 wherein the target height is identified by visual indication of a flexible pointer aligned with a midpoint of a beveled corner of a base of one of the first or second box units.

6. The method of claim 1 wherein the target height is determined by a horizontal segment of visible laser cross lines.

7. The method of claim 6 wherein the predetermined horizontal position is determined by a vertical segment of the laser cross lines.

* * * * *